US006692274B2

(12) United States Patent
Maegawa

(10) Patent No.: US 6,692,274 B2
(45) Date of Patent: Feb. 17, 2004

(54) CONNECTOR PROVIDED WITH A MOVING PLATE

(75) Inventor: Takao Maegawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/307,795

(22) Filed: Dec. 2, 2002

(65) Prior Publication Data

US 2003/0109167 A1 Jun. 12, 2003

(30) Foreign Application Priority Data

Dec. 7, 2001 (JP) ..... 2000-374588

(51) Int. Cl.[7] ..... H01R 13/62
(52) U.S. Cl. ..... 439/157
(58) Field of Search ..... 439/157, 140, 439/160, 372

(56) References Cited

U.S. PATENT DOCUMENTS 6,464,522 B2 * 10/2002 Osawa et al. ..... 439/271
6,533,602 B2 * 3/2003 Nankou ..... 439/352
6,544,054 B2 * 4/2003 Ishikawa et al. ..... 439/157
2002/0022391 A1 * 2/2002 Beck et al. ..... 439/157
2002/0182908 A1 * 12/2002 Maegawa ..... 439/157
2003/0008537 A1 * 1/2003 Nishide ..... 439/157

FOREIGN PATENT DOCUMENTS

JP 11-67338 7/1989

* cited by examiner

*Primary Examiner*—Tho D. Ta
(74) *Attorney, Agent, or Firm*—Gerald E. Hespos; Anthony J. Casella

(57) ABSTRACT

A connector has male housing (10) with a receptacle (12) with a rear engaging surface (10A) and tabs (16) that project through the engaging surface (10A) into the receptacle (12). A moving plate (50) is disposed in the receptacle (12) for movement toward and away from the engaging surface (10A) and has a back wall (51) with holes (53) for aligning the tabs (16). A female housing (20) is insertable into the receptacle (12) and has a contact surface (20) and female terminal fittings. The back wall (51) of the moving plate (50) has a smaller thickness (t2) near holding holes (53) and reinforcing ribs (61) with a larger thickness (t1) at other locations. Recesses (63) are formed in the engaging surface (10A) of the male housing (10) for nesting with the reinforcing ribs (61).

14 Claims, 7 Drawing Sheets

CONNECTOR PROVIDED WITH A MOVING PLATE

BACKGROUND OF THE INVENTION

1 Field of the Invention

The invention relates to a connector with a moving plate.

2 Description of the Related Art

Japanese Unexamined Patent Publication No. 11-67338 discloses a connector with a male housing that has a receptacle. Male terminal fittings are mounted in the housing and have tabs that project into the receptacle. The connector also has a moving plate formed with holes through which tabs of male terminal fittings penetrate. The moving plate is inserted into the receptacle for movement along connecting directions of the male housing with a female housing. The moving plate aligns tabs of the male terminal fittings in the receptacle and prevents the tabs from being deformed by an external force. The moving plate initially is mounted at an opening side of the receptacle so that the leading ends of the tabs are located in the holes. The mating female housing then is fit into the receptacle of the male housing so that the facing female and male terminal fittings connect. The holes move along the tabs and the moving plate moves deeper into the receptacle as the housings connect.

An object of the present invention is to improve a terminal contact area, to reduce the size of the connector and to ensure the rigidity of a moving plate.

SUMMARY OF THE INVENTION

The invention is directed to a connector with a male housing that has a receptacle. Male terminal fittings are accommodated in the male housing so the tabs of the male terminal fittings project into the receptacle. The connector also includes a female housing that is fittable into the receptacle and female terminal fittings are accommodated in the female housing. A moving plate is disposed in the receptacle for movement along the connecting directions of the male and female housings. The moving plate has holes through which the tabs of the male terminal fittings penetrate. One of the surfaces of the moving plate is thinned at least at an area where the holes are formed. At least one thicker portion remains for reinforcement, and at least one recess or groove is formed in a contact surface of the mating housing for receiving the reinforcing portion.

The moving plate is held closely between the engaging surfaces of the male and female housings when the housings are connected properly, and the reinforcing portion escapes into the recess of the mating housing. The moving plate is thinner in the area around the holes. Thus, the distance of the tabs in the moving plate is reduced and the distance of the tabs entering the female housing is increased. This results in higher contact reliability between the female and male terminal fittings. On the other hand, the thicker portion displays a reinforcing function to ensure the rigidity of the moving plate.

The reinforcing portion preferably is formed in an area outside cavities of the mating housing. Thus, the escaping recess in the contact surface of the mating housing need only be formed in the area outside the cavities, and the cavities need not be made smaller.

The moving plate preferably comprises a back wall with the reinforcing portion and one or more peripheral walls. The moving plate preferably is insertable into the receptacle while holding the peripheral wall in sliding contact with the receptacle.

Most preferably, the female housing is fittable into the moving plate.

An operating means may be provided on one of the male and female housings for displaying a cam action to connect the male and female housings upon operation of the operating means. The moving plate also preferably is displaced by the cam action of the operating means.

The cam means preferably comprises a follower pin integrally formed by a first cam part provided at one of the male housing and the female housing and by a second cam part provided at the moving plate.

These and other objects, features and advantages of the invention will become more apparent upon reading of the following detailed description and accompanying drawings. It should be understood that even though embodiments are described separately, single features may be recombined.

DETAILED DESCRIPTION OF THE PREFERRED EMBODIMENTS

A lever-type connector according to the invention includes male and female housings 10 and 20, as shown in FIGS. 1 to 7. In the following description, mating ends of the housings 10, 20 are referred to as the front ends.

Figure 3:
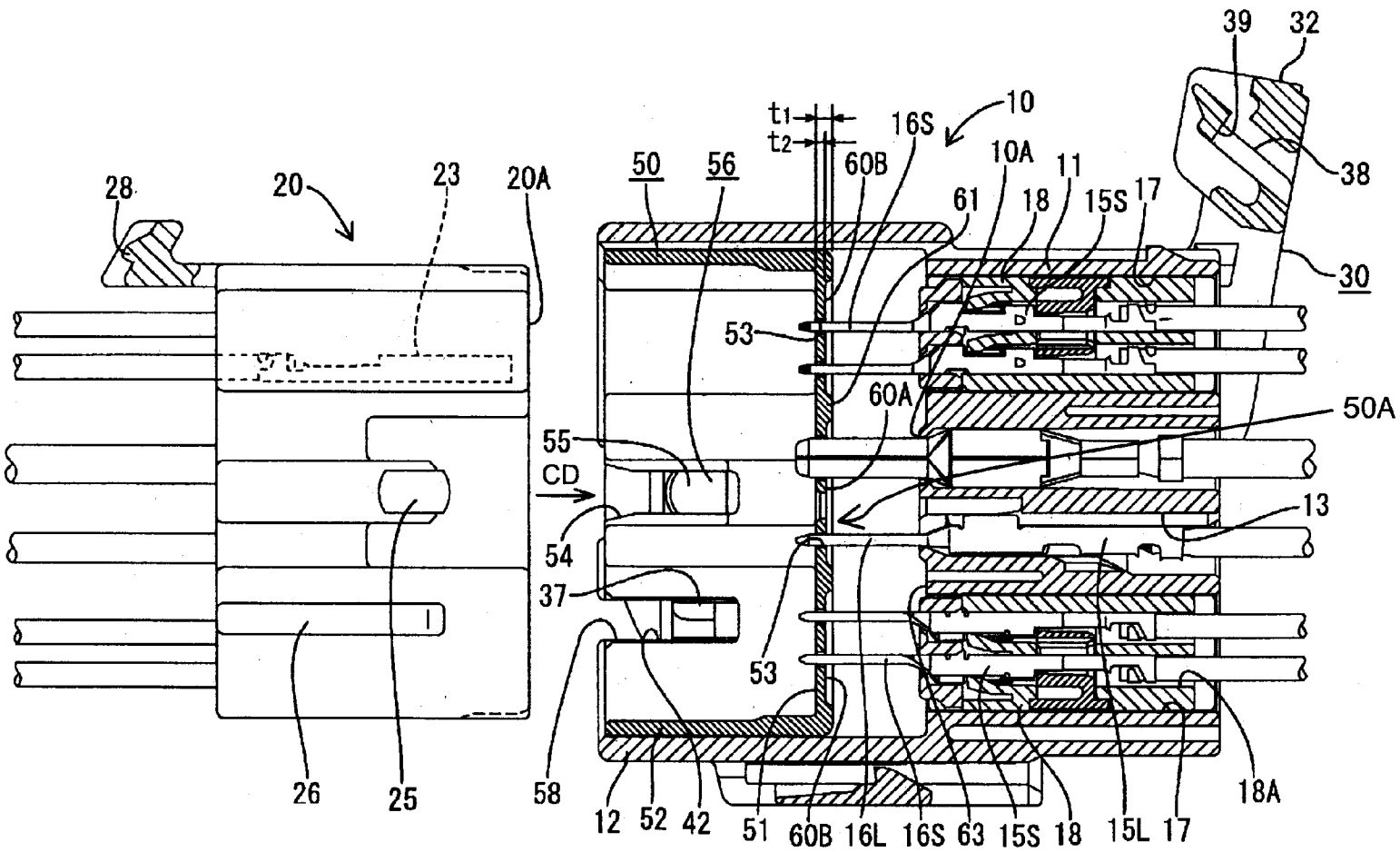
FIG. 3. is a side view of the housings partly in section.

The male housing 10 is formed e.g. of a synthetic resin and has a main body 11 with a receptacle 12 at the front end of a main body 11. As shown in FIG. 3, cavities 13 are formed in the middle of the main body 11 along a height direction and large male terminal fittings 15L are inserted into the cavities 13 from behind. Accommodating holes 17 are formed at upper and lower ends of the male housing 10 and separate auxiliary housings 18 are accommodated therein so that the front surfaces of the auxiliary housings 18 are substantially flush with an engaging surface 10A of the male housing 10. Thus, the male housing 10 is of the hybrid type. The auxiliary housings 18 have cavities 18A and small male terminal fittings 15S inserted therein.

Tabs 16L, 16S of the large and small male terminal fittings 15L, 15S project into the receptacle 12 by the same specified distance. The large and small male terminal fittings 15L, 15S and the tabs 16L, 16S are referred to collectively as the male terminal fittings 15 and the tabs 16.

A cup-shaped moving plate 50 is mounted in the receptacle 12. The moving plate 50 is formed e.g. of a synthetic resin and has a back wall 51 and a surrounding wall 52. As shown in FIG. 3, the back wall 51 has holes 53, and the tabs 16L, 16S of the male terminal fittings 15L, 15S penetrate closely through the holes 53 so as to be held straight. The moving plate 50 is movable forward and backward along connecting directions CD of the housings 10, 20 while holding the surrounding wall 52 substantially in sliding contact with the inner circumferential surface of the receptacle 12.

The female housing 20 also is formed e.g. of a synthetic resin and is substantially in the shape of a block that fits within the surrounding wall 52 of the moving plate 50. Cavities 21 are formed substantially in the middle of the female housing 20 along a height direction, and large female terminal fittings (not shown) are inserted into the cavities 21 from behind. Accommodating holes 22 are formed at the upper and lower ends of the female housing 20, and separate auxiliary housings 24 are mounted in the accommodating holes 22. Thus, the female housing 20 also is of the hybrid type. The female housings 20 have small female terminal fittings 23 (see FIG. 3) inserted therein.

A lever 30 is mounted on the male housing 10. The lever 30 also is formed e.g. of a synthetic resin and has two wide arms 31 connected by an operable portion 32 to define a U-shape. The arms 31 are mounted outside the left and right sides of the male housing 10. A shaft hole 33 is formed substantially in the middle of each arm 31, and the shaft holes 33 engage shafts 34 that project at side surfaces of the receptacle 12. Thus the lever 30 is rotatably between a start position shown in FIGS. 2 and 3 and an end position shown in FIG. 7. A cam groove 35 is formed in each arm 31 of the lever 30, and an entrance 36 thereof opens at the leading edge of the arm 31.

Figure 1:
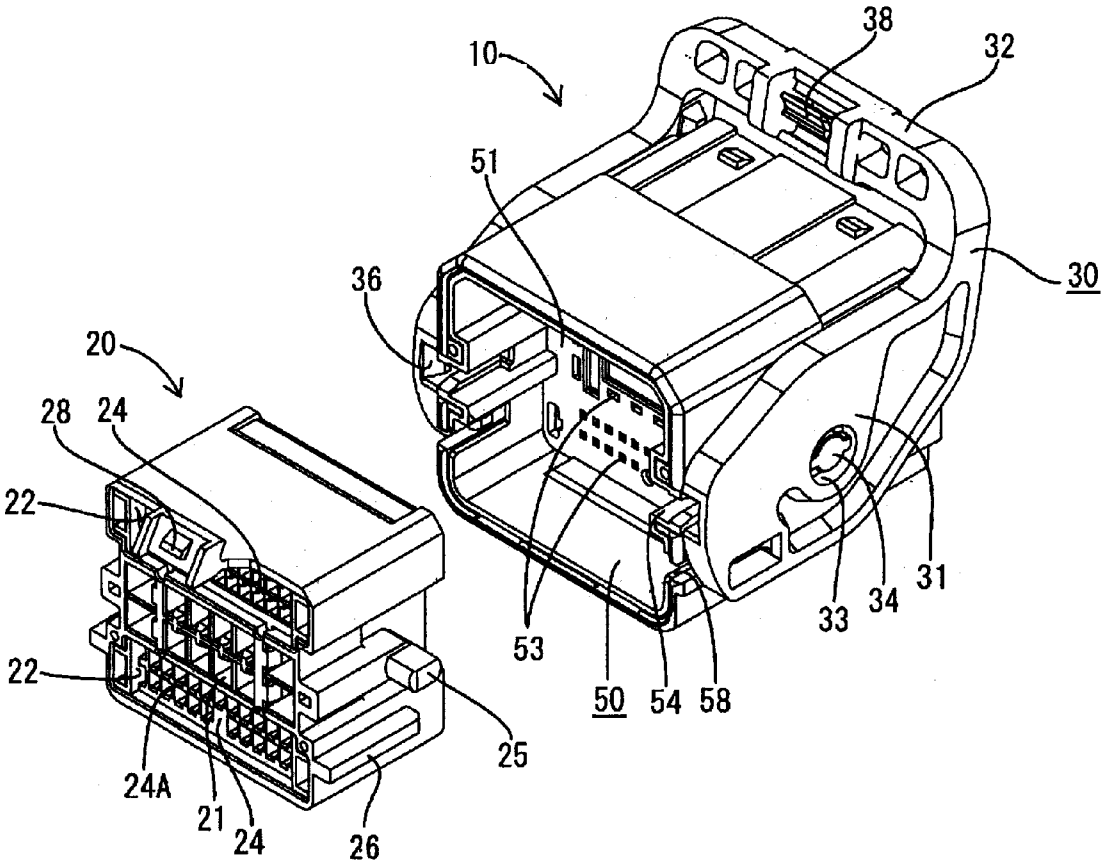
FIG. 1 is a perspective view showing a state before male and female housings according to one embodiment of the invention are connected.
Figure 2:
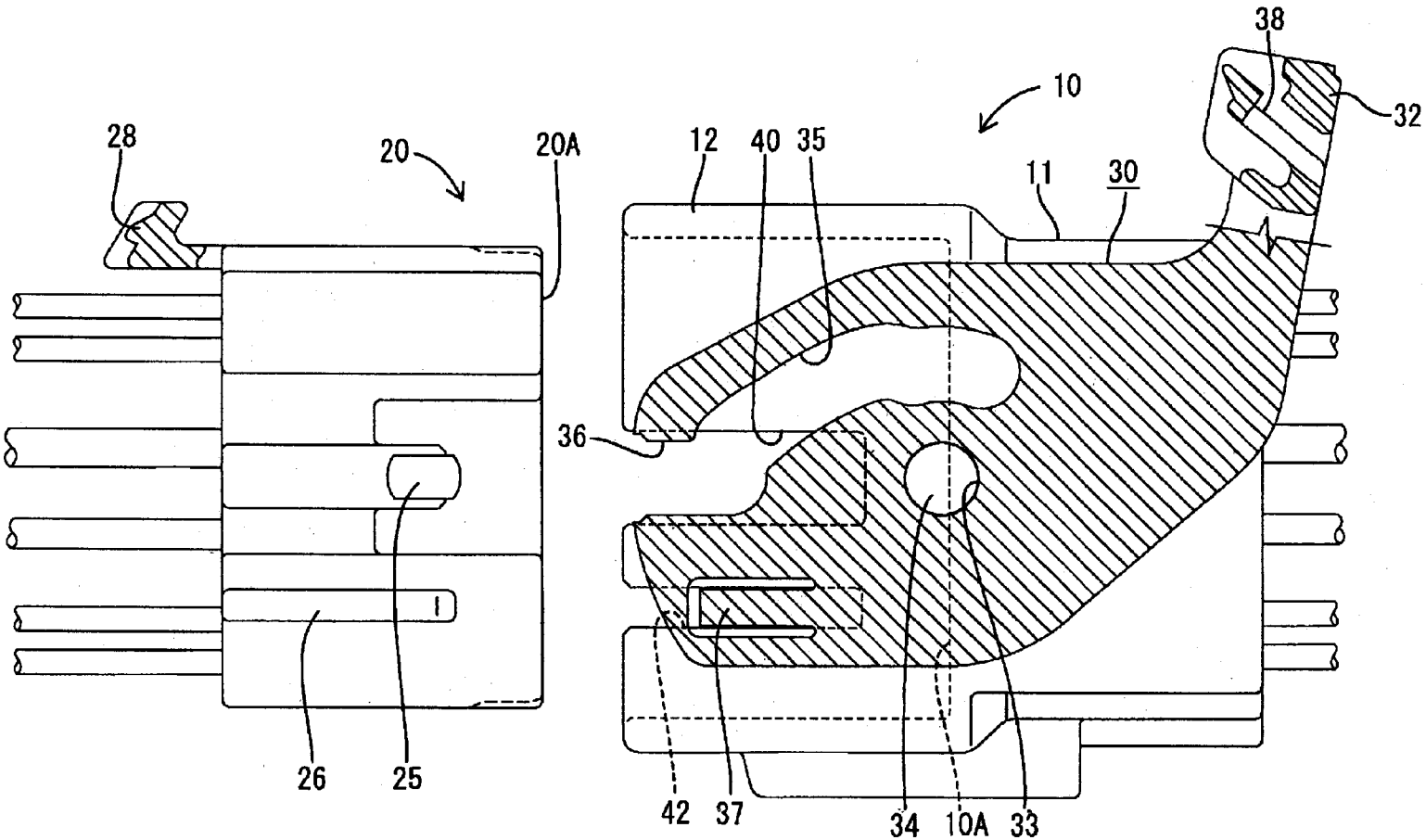
FIG. 2. is a side view of the housings with the lever in section.

An inner pin 25 projects at each of the left and right lateral side surfaces of the female housing 20, whereas an insertion groove 54 is formed in each of the left and right lateral side surfaces of the moving plate 50 and the corresponding inner pin 25 is insertable into the respective insertion groove 54. An outer pin 55 projects out at the back end of each insertion groove 54 (see FIG. 4). When the female housing 20 is fit to the back end or mating side of the moving plate 50, the inner pins 25 pass through the insertion grooves 54 and fit with the outer pins 55 to form integrated follower pins 56. Further, an entrance groove 40 is formed in each of the left and right lateral surfaces of the receptacle 12 of the male housing 10 and extends substantially forward and backward in longitudinal directions, as shown in FIG. 2. The integrated follower pins 56 can enter the entrance grooves 40.

A resiliently deformable partial locking piece 37 is cantilevered from the leading end of each arm 31 of the lever 30 substantially opposite from the end where the cam groove 35 is formed. On the other hand, a guide groove 42 is formed in each of the left and right lateral side surfaces of the receptacle 12. The guide grooves 42 are open at the front edge of the receptacle 12 and extend in forward and backward longitudinal directions. As shown in FIG. 2, the partial locking pieces 37 fit into the guide grooves 42 for partly holding the lever 30 at the initial position so as not to rotate. When the lever 30 is at the initial position (FIGS. 2, 3), the entrance 36 of each cam groove 35 aligns with the corresponding entrance groove 40 and opens forward toward the mating side.

Ribs 26 are formed respectively on the left and right lateral surfaces of the female housing 20 for entering the corresponding guide grooves 42. The entrance of the ribs 26 causes the partial locking pieces 37 to deform resiliently out of the guide grooves 42, thereby permitting rotation of the arms 31 and hence rotation of the entire lever 30. The moving plate 50 is formed with escaping grooves 58 for the ribs 26 in the left and right lateral surfaces.

Figure 7:
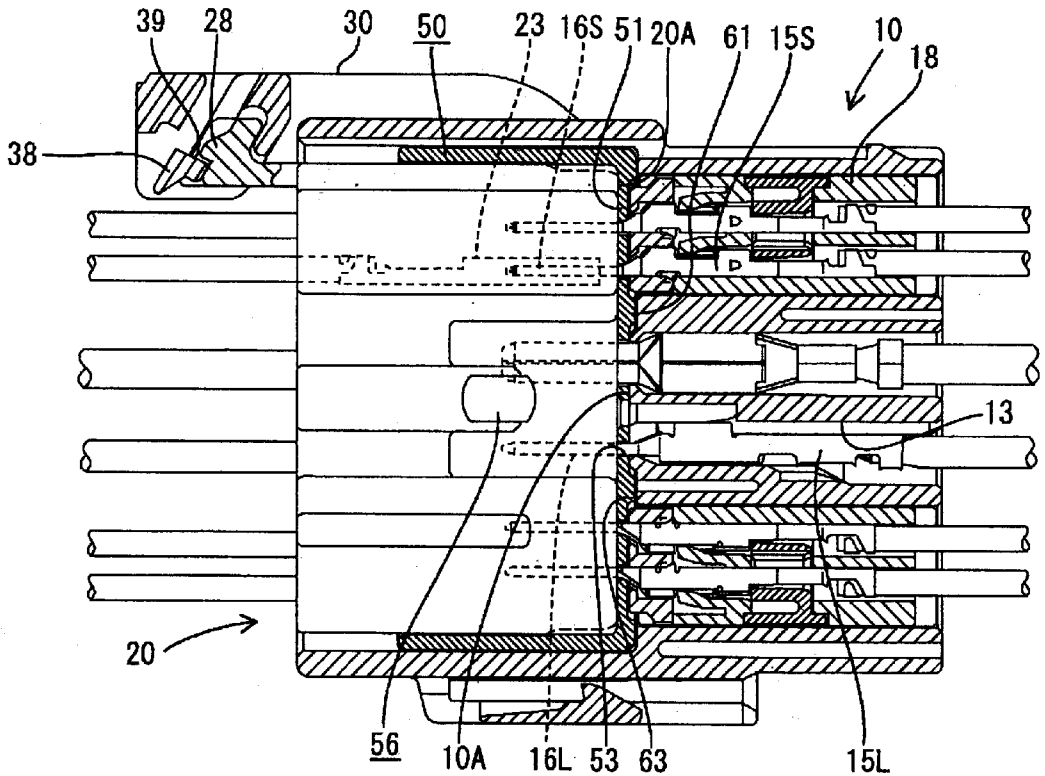
FIG. 7 is cross-sectional of the properly connected housings.

A locking mechanism 28, 38, 39 is provided between the lever 30 and the female housing 20 for locking the lever 30 at the final position (FIG. 7). More particularly, a resiliently deformable locking piece 38 is cantilevered substantially from the middle of the operable portion 32 of the lever 30 and is formed with a locking groove 39. On the other hand, a locking projection 28 is provided substantially in the widthwise middle of the rear edge of the upper surface of the female housing 20 for engaging the locking groove 39 of the locking piece 38.

Figure 4:
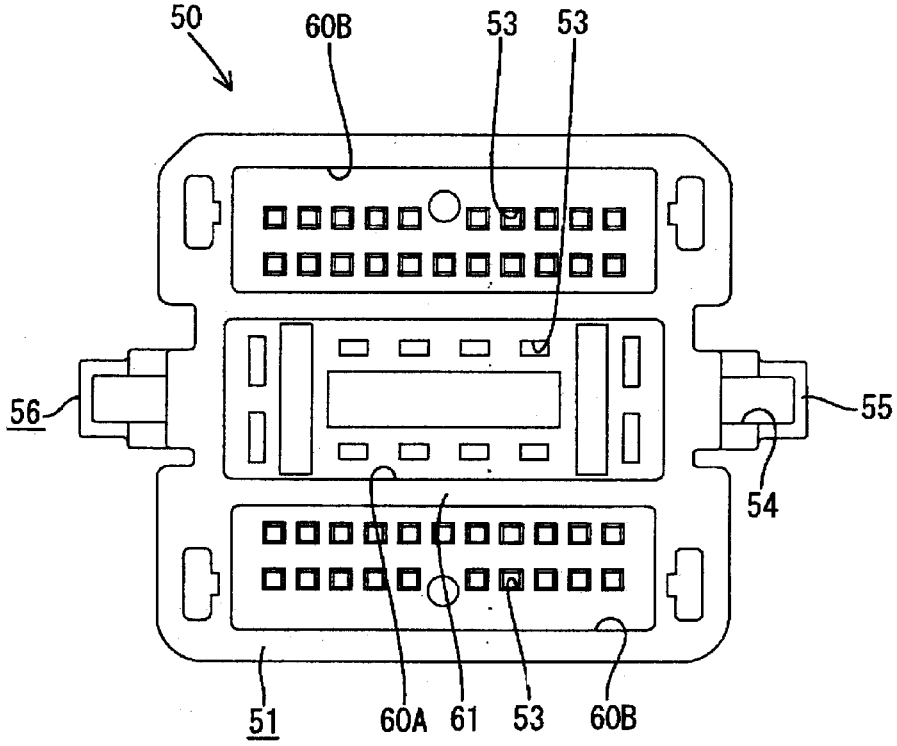
FIG. 4. is a rear view of a moving plate.

As shown in FIGS. 3 and 4, the original thickness of the back wall 51 is (t1). The rear surface (right surface in FIG. 3) of the back wall 51 is cut, recessed or thinned to have a smaller thickness (t2) in an area 60A substantially corresponding to the holding holes 53 for holding and aligning the tabs 16L of the large male terminal fittings 15L and in areas 60B at the upper and lower sides corresponding to the holding holes 53 for holding the tabs 16S of the smaller male terminal fittings 15S. The remaining portions have the original larger thickness (t1) and serve as reinforcing ribs 61.

Figure 5:
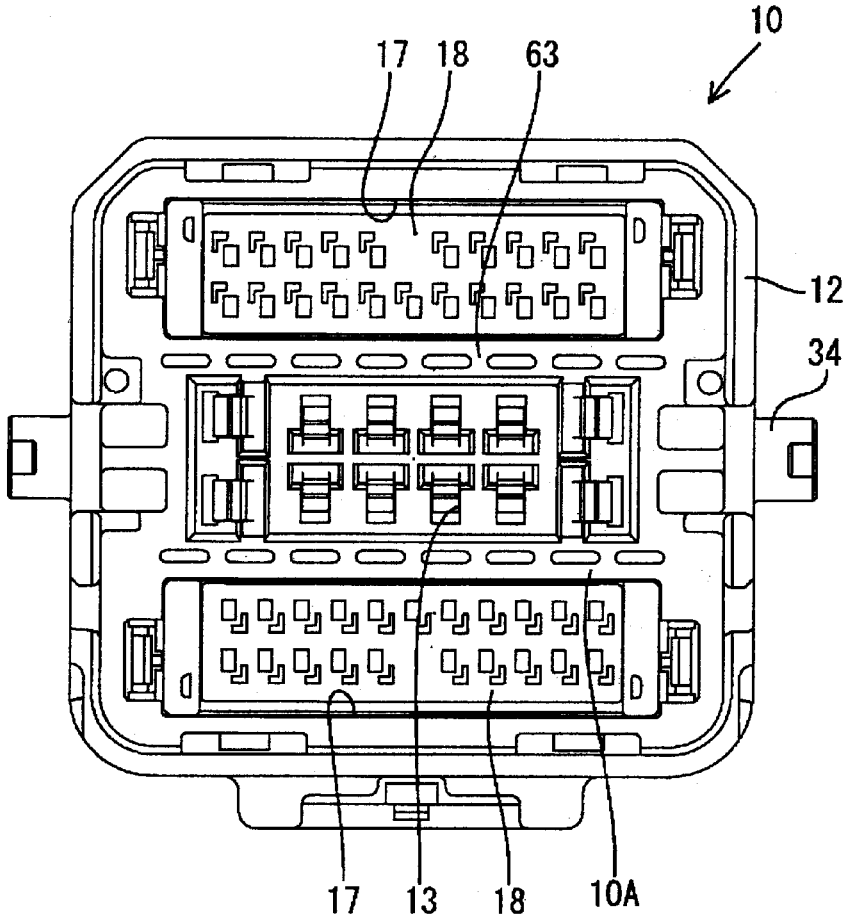
FIG. 5. is a front view of the male housing.

The engaging surface 10A of the male housing 10 (including the front surfaces of the auxiliary housings 18) that contacts the back surface 50A of the back wall 51 of the moving plate 50 has grooves or recesses 63 that receive and nest with the reinforcing ribs 61, as shown in FIGS. 3 and 5.

The connector is assembled by positioning the lever 30 of the male housing 10 at the initial position (FIGS. 2, 3), and mounting the moving plate 50 at a specified position near the opening edge in the receptacle 12, as shown in FIG. 3. At this stage, the tabs 16 of the male terminal fittings 15 that project from the engaging surface 10A of the male housing 10 pass through the corresponding holding holes 53 in the back wall 51 of the moving plate 50. Thus, the tabs 16 are positioned by the holding holes 53 and project slightly forward from the back wall 51. The outer pins 55 of the moving plate 50 pass through the entrance grooves 40 into the entrances 36 of the cam grooves 35.

Figure 6:
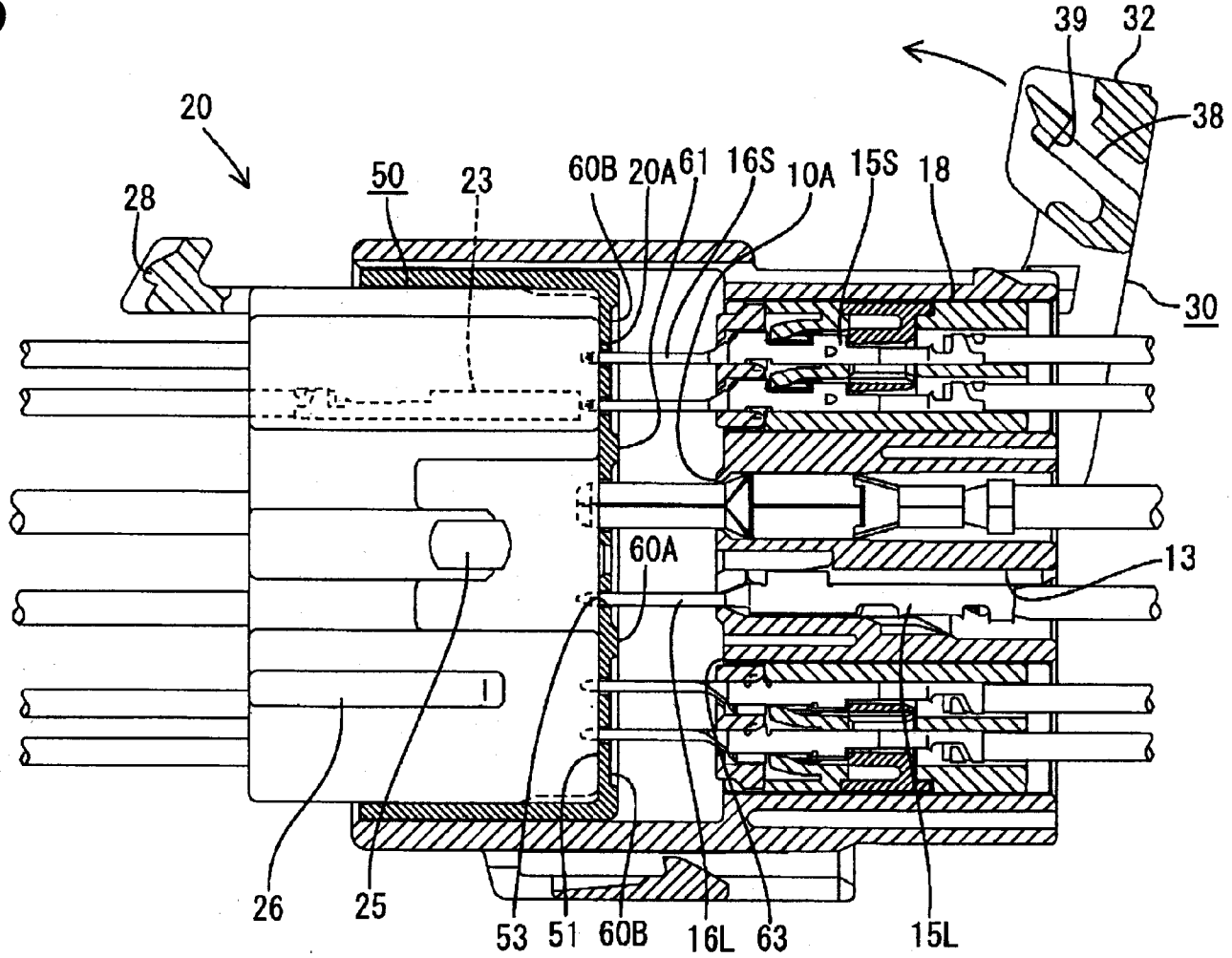
FIG. 6. is a cross-sectional of the partly connected housings.

The female housing 20 is fit into the moving plate 50 in the receptacle 12 of the male housing 10 as indicated by an arrow in FIG. 3. The female housing 20 is inserted into the moving plate 50, as shown in FIG. 6, until the engaging surface 20A contacts the front surface of the back wall 51 of the moving plate 50. Accordingly, the tabs 16 of the male terminal fittings 15 that project forward from the back wall 51 slightly enter the corresponding cavities 21, 24 of the female housing 20 from the front. At this stage, the corresponding male and female terminal fittings 15, 23 are not yet brought into contact.

Simultaneously, the inner pins 25 of the female housing 20 fit through the entrance grooves 40 and the insertion grooves 54 into the outer pins 55 to form the integrated follower pins 56 at the entrances 36 of the cam grooves 35. Further, the partial locking pieces 37 are deflected by engagement with the ribs 36 to cancel the partial locked state of the lever 30.

Manual forces then are exerted on the operable portion 32 to rotate the lever 30 in the counterclockwise direction in FIG. 6. The follower pins 56 enter the starting ends of the cam grooves 35 through the entrances 36. A cam action between the cam grooves 35 and the follower pins 25, 55 gradually pulls the female housing 20 and the moving plate 50 into the receptacle 12.

The housings 10, 20 are engaged properly with each other when the lever 30 reaches the end position, as shown in FIG. 7. At this stage, the moving plate 50 is held closely between the engaging surfaces 10A, 20A of the housings 10, 20 and the reinforcing ribs 61 nest in the recesses 63 in the engaging surface 10A of the male housing 10. Accordingly, the tabs 16 of the male terminal fittings 15 enter the female housing 20 more deeply and contact the mating female terminal fittings 23.

The locking piece 38 resiliently deforms over the locking projection 28 when the lever 30 is rotated to the end position (FIG. 7). Thus, the locking projection 28 engages locking groove 39. Accordingly, the lever 30 is locked so as not to return, and the housings 10, 20 are locked in their properly connected state.

As described above, the areas 60A, 60B of the back wall 51 of the moving plate 50 near or corresponding to the holding holes 53 are thinned or cut away. Accordingly, the distance of the tabs 16 of the male terminal fittings 15 located in the back wall 51 of the moving plate 50 is reduced, thereby increasing the distance of the tabs 16 entering the female housing 20 and increasing contact areas with the female terminal fittings 23. This results in higher contact reliability between the male and female terminal fittings 15, 23. On the other hand, the thicker reinforcing ribs 61 left uncut and having a greater thickness than the areas 60A and/or 60B display a reinforcing function to ensure rigidity of the back wall 51 of the moving plate 50.

The reinforcing ribs 61 on the back wall 51 of the moving plate 50 are in the areas corresponding to areas away from the cavities of the male housing 10, including the directly formed cavities 13 and the cavities 18A in the auxiliary housing 18. Accordingly, the recesses 63 are formed only in areas of the engaging surface 10A of the male housing 10 that will receive and nest with the reinforcing ribs 61. Therefore, neither the cavities 13 directly formed in the male housing 10 nor the cavities 18A in the auxiliary housing 18 need to be changed in form or need to be made smaller by the recesses 63.

The invention is not limited by described and illustrated embodiment. For example, the following embodiments are embraced by the scope of the invention as defined in the claims and further changes can be made without departing from the scope and spirit of the invention as defined in the claims:

Although the back surface of the bottom wall facing the engaging surface of the male housing is cut in the foregoing embodiment, the front surface of the bottom wall facing the engaging surface of the female housing may be conversely cut. In such a case, the reinforcing ribs are formed on the front surface of the bottom wall, and the recesses for nesting with the reinforcing ribs may be formed in the engaging surface of the female housing.

The connector housing may not be of the divided or hybrid type, but may be of the normal type in which the cavities are formed directly.

The invention is also applicable to connectors with a moving plate, but with no lever, or connectors with a different moving member, such as a member that is substantially linearly displaceable for displaying a cam action.

What is claimed is:

1. A connector, comprising:

a male housing with a receptacle having opposed pairs of outer walls extending parallel to a connecting direction and an engaging surface in the receptacle perpendicular to the connecting direction;

male terminal fittings accommodated in the male housing and having tabs that project through the engaging surface and into the receptacle, the male terminal fittings being disposed in a non-symmetrical pattern relative to at least one plane centrally between the outer walls in at least one of the pairs of outer walls;

a female housing dimensioned for fitting into the receptacle and having an engaging surface opposed to the engaging surface of the male housing when the female housing is fit in the receptacle;

female terminal fittings accommodated in the female housing and mateable with the tabs of the male terminal fittings through the engaging surface;

a moving plate movable in the receptacle along connecting directions of the male and female housings, the moving plate being formed with holding holes through which the tabs of the male terminal fittings project, the moving plate having at least one thinned area substantially surrounding at least selected ones of the holding holes, the moving plate further having at least one thicker reinforcing area; and a recess formed on at least one of the engaging surfaces for nesting with the reinforcing area of the moving plate.

2. The connector of claim 1, wherein the reinforcing area is in an area of the moving plate spaced outwardly from the holding holes of the moving plate.

3. The connector of claim 1, wherein the moving plate comprises a back wall provided with the reinforcing area and at least one peripheral wall.

4. The connector of claim 3, wherein the moving plate is movably insertable into the receptacle while holding the peripheral wall substantially in sliding contact with the receptacle.

5. The connector of claim 4, wherein the moving plate has a plurality of the peripheral walls, the female housing being fittable within the peripheral walls of the moving plate.

6. A connector, comprising:

a male housing (10) with a receptacle (12) and an engaging surface (10A) in the receptacle (12);

male terminal fittings accommodated in the male housing and having tabs that project through the engaging surface and into the receptacle;

a female housing dimensioned for fitting into the receptacle and having an engaging surface opposed to the engaging surface of the male housing when the female housing is fit in the receptacle;

female terminal fittings accommodated in the female housing and mateable with the tabs of the male terminal fittings through the engaging surface:

a moving plate movable in the receptacle along connecting directions of the male and female housings, the moving plate being formed with holding holes through which the tabs of the male terminal fittings project, the moving plate having at least one thinned area substantially surrounding at least selected ones of the holding holes, the moving plate further having at least one thicker reinforcing area;

a recess formed on at least one of the engaging surfaces for nesting with the reinforcing area of the moving plate; and an operating means is provided on one of the male and female housings for displaying a cam action to connect the male and female housings upon operation of the operating means, the operating means having partial locking pieces for holding the operating means at an initial position until the female housing is fit partly into the receptacle.

7. The connector of claim 6, wherein the operating means further is operative for displacing the moving plate.

8. The connector of claim 7, wherein a cam means is provided at the operating means and at least one of the male housing and the female housing for displaying the cam action.

9. The connector of claim 8, wherein the cam means comprises a follower pin integrally formed by a first cam part provided at one of the male housing and the female housing and by a second cam part provided at the moving plate.

10. A connector, comprising:

a male housing with opposite front and rear ends, a receptacle extending into the front end, an engaging surface facing forwardly in the receptacle, cavities extending into the rear end of the male housing and through the engaging surface;

male terminal fittings accommodated in the cavities and having tabs that project into the receptacle;

a cap-shaped moving plate slideably disposed in the receptacle and having a back wall and a plurality of peripheral walls projecting from the back wall towards the front end of the male housing, the back wall being formed with holding holes that slideably receive the tabs of the male terminal fittings;

a female housing surrounded by the peripheral walls of the moving plate and having an engaging surface opposed the back wall of the moving plate, the female housing being slideably moveable toward and away from the back wall;

female terminal fittings accommodated in the female housing and mateable with the tabs of the male terminal fittings; wherein the back wall of the moving plate has at least one thinned area surrounding at least selected ones of the holding holes and at least one thicker reinforcing area, and wherein a recess is formed on at least one of the engaging surfaces for nesting with the reinforcing area of the moving plate and wherein the peripheral walls of the moving plate are thicker at locations adjacent the back wall of the moving plate.

11. A connector, comprising:

a male housing with opposite front and rear ends, a receptacle extending into the front end, an engaging surface facing forwardly in the receptacle, cavities extending into the rear end of the male housing and through the engaging surface, reinforcing recesses being formed in the engaging surface and facing into the receptacle at locations spaced from the cavities; and a cap-shaped moving plate slideably disposed in the receptacle and having a back wall and a plurality of peripheral walls projecting from the back wall towards the front end of the male housing, the back wall being formed with holding holes substantially aligned with the cavities, the back wall of the moving plate having at least one thinned area surrounding at least selected ones of the holding holes and thicker reinforcing areas configured for nesting with the reinforcing recesses in the male housing portions of the peripheral walls adjacent the back wall being thicker than portions of the peripheral walls at locations remote from the back wall.

12. The connector of claim 11, wherein at least one of the reinforcing areas of the moving plate is disposed between the holding holes and the peripherals walls of the moving plate.

13. The connector of claim 12, further comprising male terminal fittings accommodated in the cavities and having tabs that project into the receptacle, the tabs being slideably engaged in the holding holes of the moving plate.

14. The connector of claim 13, further comprising a female housing disposed within the peripheral walls of the moving plate for sliding movement towards and away from the back wall of the moving plate.

* * * * *